US011278111B2

(12) United States Patent
Buchleither et al.

(10) Patent No.: US 11,278,111 B2
(45) Date of Patent: Mar. 22, 2022

(54) METHOD AND DEVICE FOR PRODUCING BRISTLE FIELDS FOR BRUSHES AND BRUSH MAKING MACHINE

(71) Applicant: Zahoransky AG, Todtnau (DE)

(72) Inventors: Dirk Buchleither, Schopfheim (DE); Thomas Braunsberger, Todtnau (DE); Christian Durr, Todtnau (DE)

(73) Assignee: Zahoransky AG, Todtnau (DE)

( * ) Notice: Subject to any disclaimer, the term of this patent is extended or adjusted under 35 U.S.C. 154(b) by 141 days.

(21) Appl. No.: 16/337,111

(22) PCT Filed: Aug. 9, 2018

(86) PCT No.: PCT/EP2018/071570
§ 371 (c)(1),
(2) Date: Mar. 27, 2019

(87) PCT Pub. No.: WO2019/081088
PCT Pub. Date: May 2, 2019

(65) Prior Publication Data

US 2021/0361062 A1 Nov. 25, 2021

(30) Foreign Application Priority Data

Oct. 26, 2017 (DE) ..... 102017125046.8

(51) Int. Cl.
*A46D 3/04* (2006.01)
*A46B 9/04* (2006.01)

(52) U.S. Cl.
CPC ..... *A46D 3/04* (2013.01); *A46B 9/04* (2013.01); *A46B 2200/1066* (2013.01)

(58) Field of Classification Search
CPC ..... A46D 3/005; A46D 3/04; A46D 3/082; A46B 9/04; A46B 2200/1066
USPC ..... 264/243; 300/21, 7, 4
See application file for complete search history.

(56) References Cited

U.S. PATENT DOCUMENTS

| | | | | |
|---|---|---|---|---|
| 10,849,423 | B2 * | 12/2020 | Boucherie | B29C 66/8432 |
| 2014/0339395 | A1 | 11/2014 | Kumpf et al. | |
| 2021/0137257 | A1 * | 5/2021 | Varch | A46B 3/06 |

FOREIGN PATENT DOCUMENTS

| | | |
|---|---|---|
| DE | 102010055686 | 6/2012 |
| EP | 2803294 | 11/2014 |
| WO | 2017088940 | 6/2017 |

* cited by examiner

*Primary Examiner* — Orlando E Aviles
*Assistant Examiner* — Sarah Akyaa Fordjour
(74) *Attorney, Agent, or Firm* — Volpe Koenig

(57) ABSTRACT

A method and device for the production of bristle fields for brushes is provided. The method for producing bristle fields includes filling bundle holders (3) of a bristle field support plate (2) with bundles of bristles using at least two different funnel plates (4, 5). The device includes at least two different funnel plates with complementary hole patterns in relation to a complete hole pattern (13) formed by inlet openings (12) of the bundle holders (3) on the bristle field support plate.

20 Claims, 2 Drawing Sheets

METHOD AND DEVICE FOR PRODUCING BRISTLE FIELDS FOR BRUSHES AND BRUSH MAKING MACHINE

BACKGROUND

The invention relates to a method for producing a bristle field formed of multiple bundles of bristles for a brush, in particular for a toothbrush, wherein bundle holders of a bristle field support plate are filled with bundles of bristles.

Furthermore, the invention also relates to a device for producing bristle fields from bundles of bristles for brushes, in particular toothbrushes, wherein the device has at least one bristle field support plate with bundle holders, and a brush manufacturing machine with such device.

Such methods, devices, and brush manufacturing machines are familiar in practice in different embodiments. The bundle holders in the hole plates of these devices are arranged as a rule in the same way as the bundles of bristles in the bristle field to be produced. A bristle field, which includes multiple bundles of bristles, can be produced by filling the bundle holders of the bristle field support plate of such a device with bundles of bristles.

After filling the bundle holders of the bristle field support plate, these, together with the bristle field produced thereby from bundles of bristles, can be fed to further processing steps. At the same time, rear ends of the bundles of bristles can be over-molded, for example with plastic, and in the process can be connected to a brush body.

The bundles of bristles of the bristle field to be produced often have a cross-sectional form deviating from a circular form. The bundles of bristles, which first of all usually exhibit a circular cross-section, are delivered for reshaping to a so-called funnel plate before being transferred to the bristle field support plate. Funnel plates have funnel holders, which can have an internal cross section according to the cross-sectional form of the bundles of bristles to be produced. Furthermore, individual bundles of bristles can also be combined together into larger bundles of bristles with an appropriately designed funnel plate.

In order to be able to introduce the bundles of bristles more easily into the funnel holders and also, if necessary, to shape them in a desired manner, the funnel holders of such a funnel plate have the most generous possible lead-in chamfers or insertion funnels.

If bristle fields are to be produced with a large number of bundles of bristles, with particularly large bundles of bristles or also with a large bristle bundle density, it is possible for problems to be encountered with the previously known methods and devices. In the case of a high bristle bundle density in the bristle field, a comparatively large number of individual bundles of bristles is gathered together in a small space. As a result, the bundles of bristles in a bristle field which exhibits a high bristle bundle density stand close together. Above all in the case of bundles of bristles with challenging cross-sectional geometries, that is to say such cross-sectional geometries which deviate strongly from a circular cross-sectional form, the largest possible insertion funnels can be of critical significance for the successful implementation of the method.

Especially if the bristle field to be produced has a high bristle bundle density, however, the insertion funnels into the funnel holders of the funnel plate may have only a comparatively small size, for reasons of space, which is often insufficient for the feeding and shaping of bundles of bristles having a large or complex configuration.

SUMMARY

The object of the invention is accordingly to make available a method, a device and a brush manufacturing machine of the kind mentioned by way of introduction, which avoid the previously outlined disadvantages and simplify the production of bristle fields.

To accomplish this object, a method of the kind mentioned by way of introduction is provided, which possesses one or more features of the invention relating to such object. In particular in the method for the accomplishment of the object mentioned by way of introduction, the bundles of bristles are fed to the bundle holders of the bristle field support plate at least indirectly via funnel holders exhibiting insertion funnels, which are distributed on at least two arrangements of funnel holders in such a way that a concentration of funnel holders in the at least two arrangements is smaller in each case than a concentration of bundle holders on the bristle field support plate. As a result, the bundle holders of a bristle field support plate are filled at least indirectly with bundles of bristles from at least two different arrangements of funnel holders. In this way, the total number of funnel holders required can be distributed on at least two arrangements. This has the effect that, on each of the at least two arrangements in each case, more space is available for the individual funnel holders and also for their insertion funnels. The insertion funnels can thus be larger than has previously been the case.

In the at least two arrangements of funnel holders, in each case a group of bundles can be formed from bundles of bristles and/or in each case a bristle sub-field can be formed from bundles of bristles. The groups of bundles or bristle sub-fields produced thereby can subsequently be delivered at least indirectly one after the other to the bundle holders of the bristle field support plate. Simultaneous filling of all the bundle holders of the one bristle field support plate is thus no longer possible, although the concentration of funnel holders in the at least two arrangements can be reduced in this way to such an extent that the insertion funnels of the funnel holders can be sufficiently large and of sufficiently broad configuration for comfortable feeding of the bundles of bristles. This also facilitates the introduction and shaping of particularly large bundles of bristles, which can include many individual and/or thicker bristle filaments.

The outlet openings of the funnel holders of the at least two arrangements can form or produce different hole patterns on the at least two arrangements. A first group of bundle holders of the bristle field support plate can thus be filled with bundles of bristles from one of the at least two arrangements of funnel holders, after which a second group of bundle holders is filled with bundles of bristles from the second of the at least two arrangements of funnel holders. This can continue to take place until all the bundle holders of the bristle field support plate are filled with bundles of bristles.

If the funnel holders inside an arrangement of funnel holders have longitudinal axes that are parallel to one another, the bundles of bristles can be introduced into the funnel holders without any deflection and thus particularly easily.

It can be particularly advantageous if hole patterns formed by outlet openings of the funnel holders on the at least two funnel plates are complementary in relation to a complete hole pattern formed from inlet openings of the bundle holders on the bristle field support plate. As a result, all bundle holders of the bristle field support plate can be filled with the at least two funnel plates in a number of filling steps, which number corresponds to the number of the at least two arrangements of funnel holders. It is possible, furthermore, for all the bundle holders of the bristle field support plate to be capable of being filled with bundles of bristles from the at least two arrangements. The bundles of bristles can thus be delivered from outlet openings of the at least two arrangements of funnel holders to the bundle holders of the bristle field support plate, which form or produce hole patterns that are complementary to one another with their outlet openings in relation to the complete hole pattern on the bristle field support plate.

It is also possible, however, in addition to consolidate the bundles of bristles ahead of their transfer into the bundle holders of the bristle field support plate first of all. For this purpose, the bundles of bristles can be delivered from outlet openings of the funnel holders of the at least two arrangements first of all to compactor holders. From the compactor holders the bundles of bristles can then be delivered appropriately consolidated to the bundle holders of the bristle field support plate.

In one embodiment of the method, bristle sub-fields that are complementary to one another in relation to the bristle field to be produced can be formed from bundles of bristles in the at least two arrangements. The at least two bristle sub-fields that are complementary to one another can subsequently be combined together, preferably one after the other, in the bristle field support plate in order to form the bristle field to be produced. In the process, the bundles of bristles of the two bristle sub-fields in the previously described compactor holders can continue to be consolidated first of all and then fed to the bundle holders of the bristle field support plate.

The bundles of bristles can be introduced by positive pressure and/or negative pressure, preferably by compressed air, into the funnel holders of the at least two arrangements. However, especially if a high consolidation of the bundles of bristles is desired in the funnel holders and also in the downstream bundle holders of the bristle field support plate, it may be appropriate to introduce the bundles of bristles into the funnel holders of the at least two arrangements by a single sliding mechanism or by one sliding mechanism in each case. Because of the different hole patterns, which the at least two arrangements can exhibit, an individual, suitably designed sliding mechanism can be assigned, most preferably in each case, to each of the at least two arrangements.

The one or the multiple sliding mechanisms can have sets of sliding pins, for example, which comprise sliding pins arranged according to the hole patterns of the arrangements. The sliding pins of a set of sliding pins can be arranged in this case in such a way that the bundles of bristles that are present in the funnel holders of the arrangement assigned to the set of sliding pins can be ejected from the funnel holders by the sliding pins and, for example, can be delivered to the bundle holders of the bristle field support plate assigned to the funnel holders or also to possibly interposed compactor holders.

At this point, it should be noted that, instead of a high consolidation of the bundles of bristles in the respective funnel holders for bundles of bristles or bundle holders of the bristle field support plate, it is also possible to make reference to a high degree of filling of the funnel holders and also of the downstream bundle holders.

The bundles of bristles can be contoured as a result of their introduction into the funnel holders of the at least two arrangements in order to produce a desired cross-sectional form in the bristle field to be produced. This means that the cross-sectional geometries of the bundles of bristles can be changed as a result of the introduction of the bundles of bristles into the funnel holders. It can be particularly advantageous in this context if all the funnel holders are equipped with insertion funnels.

A funnel plate adapted for changing the cross-sectional form of the bundles of bristles can also be designated as a contour plate.

To accomplish the object, a device of the kind mentioned by way of introduction having one or more features of the invention relating to such device is also provided. It is provided in particular, in the case of a device for producing bristle fields of the kind mentioned by way of introduction, that the device has at least two arrangements of funnel holders, in which in each case a concentration of funnel holders is smaller than a concentration of bundle holders in the bristle field support plate, and from which the bundle holders of the at least one bristle field support plate are capable of being filled at least indirectly with bundles of bristles. In the case of the inventive device, the total number of funnel holders required for filling the bundle holders of the bristle field support plate with bundles of bristles can also be distributed in at least two, in particular different, arrangements of funnel holders. These arrangements of funnel holders can also be designated as patterns. It is also possible that the arrangements of the funnel holders differ from one another.

The device can preferably be adapted for the implementation of the method.

The at least two arrangements can be formed on a common funnel plate. It is also conceivable and provided, however, that each of the at least two arrangements is formed in each case on one individual funnel plate. As a result, the device then has a number of funnel plates which is as large as the number of arrangements of funnel holders.

When using one funnel plate per arrangement, it can also be provided that a base surface of each of the then at least two funnel plates is as large as a base surface of the bristle field support plate. The insertion funnels of the funnel holders of an arrangement do not overlap. Nevertheless, the insertion funnels of the total number of funnel holders that are present can be so large that images of the insertion funnels overlap in the case of an intended superposition of the insertion funnels on the bristle field support plate to be filled. As a result, more space is available for each insertion funnel on the at least two arrangements, than would be the case for an arrangement having all the funnel holders, of which the concentration of funnel holders is as large as the concentration of bundle holders on the bristle field support plate. This has the effect that large bundles of bristles with a plurality of bristle filaments can also be introduced comparatively easily into the funnel holders of the at least two arrangements through the then larger insertion funnels.

In order to achieve a low concentration of funnel holders per arrangement, and yet to be able to fill all the bundle holders of the bristle field support plate at least indirectly, the at least two arrangements can have outlet openings from their funnel holders which form or produce different hole patterns.

In order to fill all the bundle holders of the bristle field support plate with bundles of bristles for producing a bristle field, hole patterns, which are formed from or are outlet openings of the funnel holders on the at least two arrangements, can be complementary to one another in relation to a complete hole pattern, which is formed from or is inlet openings of the bundle holders on the bristle field support plate. Furthermore, funnel holders inside an arrangement of funnel holders can exhibit parallel longitudinal axes to one another. In particular, this can be necessary and/or advantageous if particularly complex bristle field geometries are to be produced with the device, which, if necessary, also comprise such bundles of bristles, of which the cross-sectional form deviates strongly from a circular cross-section. The feeding of bundles of bristles into and out of such funnel holders, which exhibit parallel longitudinal axes to one another, can actually be comparatively easy.

It can be particularly appropriate in this context if a number of funnel holders of the at least two arrangements is as large as a total number of bundle holders of the bristle field support plate to be filled.

In particular in the case of hole patterns, which are complementary to one another in relation to a complete hole pattern formed from the inlet openings into the bundle holders, a superposition of the hole patterns formed on the bristle field support plate from the outlet openings on the at least two arrangements can correspond to the complete hole pattern produced by inlet openings of the bundle holders on the bristle field support plate. As a result, a simultaneous delivery of the bundles of bristles of one of the at least two arrangements to the bristle field support plate can be facilitated, without repositioning of the arrangement on the bristle field support plate being necessary. In addition, all the bundle holders of the bristle field support plate can be filled with bundles of bristles from the at least two arrangements of funnel holders in this way.

Furthermore, the at least two arrangements of funnel holders can be formed in such a way that an intended superposition of patterns, which are formed from longitudinal axes of the funnel holders, on the bristle field support plate corresponds to an overall pattern formed from longitudinal axes of the bundle holders. The patterns and the overall pattern intended here can be dot patterns, which, on the one hand, consist of points of intersection of the longitudinal axes of the funnel holders with cross-sectional planes of the at least two arrangements and, on the other hand, consist of points of intersection of the longitudinal axes of the bundle holders with a cross-sectional plane of the bristle field support plate.

Precisely one of the outlet openings of the at least two arrangements of funnel holders can be assigned to each bundle holder and/or inlet opening into a bundle holder of the bristle field support plate. As a result, outlet openings from funnel holders and inlet openings of the bundle holders of the bristle field support plate that are assigned to one another can have the same cross-sectional form. The delivery of the bundles of bristles from the funnel holders into the bundle holders of the bristle field support plate can thus take place as simply as possible.

Especially if the bundles of bristles are not delivered directly from the arrangements of funnel holders to the bundle holders of the bristle field support plate, it is possible that the dimensions of the outlet openings from funnel holders and the inlet openings of the bundle holders that are assigned to one another also differ in the case of the same cross-sectional form.

A particularly large amount of space for insertion funnels can be present on the at least two arrangements of funnel holders if, in a hole pattern of one of the at least two arrangements, the only outlet openings from funnel holders that are combined together are those through which bundle holders on the bristle field support plate that are not directly adjacent are capable of being filled with bundles of bristles. The outlet openings and the funnel holders are thus able to adopt a sufficiently large distance to one another, whereby the insertion funnels into the funnel holders can be made sufficiently large.

It should be mentioned at this point that longitudinal axes of the funnel holders and longitudinal axes of the bundle holders can be congruent with one another at least in the transfer position of the arrangements of funnel holders on the bristle field support plate. In addition, the longitudinal axes of the funnel holders can be oriented at right angles to a plane in which the outlet openings of the funnel holders are arranged, whereas the longitudinal axes of the bundle holders can be oriented at right angles to a plane in which the inlet openings of the bundle holders are arranged.

In order to introduce the bundles of bristles into the funnel holders, the device can have a conveyor device. This conveyor device can include at least one pressure source and/or at least one pressure sink to produce a gas flow, in particular to produce a flow of compressed air. With this gas flow, the bundles of bristles can be introduced into the funnel holders of the at least two arrangements by positive pressure and/or negative pressure, preferably by compressed air.

In the case of funnel holders of a kind which, because of their internal cross section, cause a high bundle compaction or by which strong shaping or contouring of the bundles of bristles introduced into the funnel holders takes place, the resistance to insertion, which acts upon the bundles of bristles, can nevertheless be too great for feeding by a gas flow. In order to be able to overcome a greater resistance to insertion, should the need arise, the device can also comprise at least one sliding mechanism, with which bundles of bristles can be inserted into the funnel holders of the at least two arrangements and/or can be transferred from the funnel holders into the bundle holders of the bristle field support plate. The at least one sliding mechanism can comprise sets of sliding pins, which are matched to the at least two arrangements and their hole patterns. It is also possible, however, for an individual set of sliding pins or an individual sliding mechanism to be assigned to each arrangement. This can be advantageous above all in the case of arrangements of funnel holders of a kind which are of different configurations and in particular have different hole patterns.

Most preferably, the bristle field support plate can be a part or an element of the device. It is also conceivable, however, to use a bundle holder, which is itself part of a brush to be produced, as a bristle field support plate, that is to say remains on the device only during the filling and in the course of possibly upstream and/or downstream processing steps. The at least two arrangements of funnel holders of the bristle field support plate are expediently arranged upstream in the conveying direction of the bundles of bristles.

In order to bring the bundles of bristles to the desired nominal dimension and/or to further consolidate them ahead of a transfer into the bundle holders of the bristle field support plate, the device can have compactor holders. The compactor holders can be combined together into corresponding arrangements by analogy with the funnel holders. The bundles of bristles are introduced into the compactor holders from the funnel holders for a bundle of bristles compaction and then make their way into the bundle holders of the bristle field support plate. The compactor holders preferably have lead-in chamfers. These facilitate the introduction of the bundles of bristles into the compactor holders. The compactor holders can be arranged on a compactor plate or can be distributed on at least two compactor plates—in the same way as the at least two arrangements of funnel holders on their common funnel plate or on their funnel plates.

To accomplish the object, a brush manufacturing machine is also provided, which has a device for producing bristle fields.

The invention also relates to improvements in the technical field of the production of bristle fields for brushes. Inter alia, the method for producing bristle fields in which bundle holders of a bristle field support plate are filled with bundles of bristles by at least two arrangements of funnel holders, is provided for this purpose.

The concentration of funnel holders in an arrangement of funnel holders can be understood in the context of the invention as a number of funnel holders per surface, which is delimited by an intended enclosing line which encloses all the funnel holders in the arrangement. The concentration of bundle holders in the bristle field support plate can be understood in the context of the invention as a number of bundle holders per surface, which is delimited by an intended enclosing line which encloses all the bundle holders of the bristle field support plate.

BRIEF DESCRIPTION OF THE DRAWINGS

The invention is now described in more detail on the basis of illustrative embodiments of the device, although it is not restricted to these illustrative embodiments. Further illustrative embodiments can be obtained by combination of the characterizing features of individual or multiple claims with one another and/or in combination of individual or multiple characterizing features of the illustrative embodiments. The following are depicted in a highly schematized representation:

DETAILED DESCRIPTION

Figure 4:
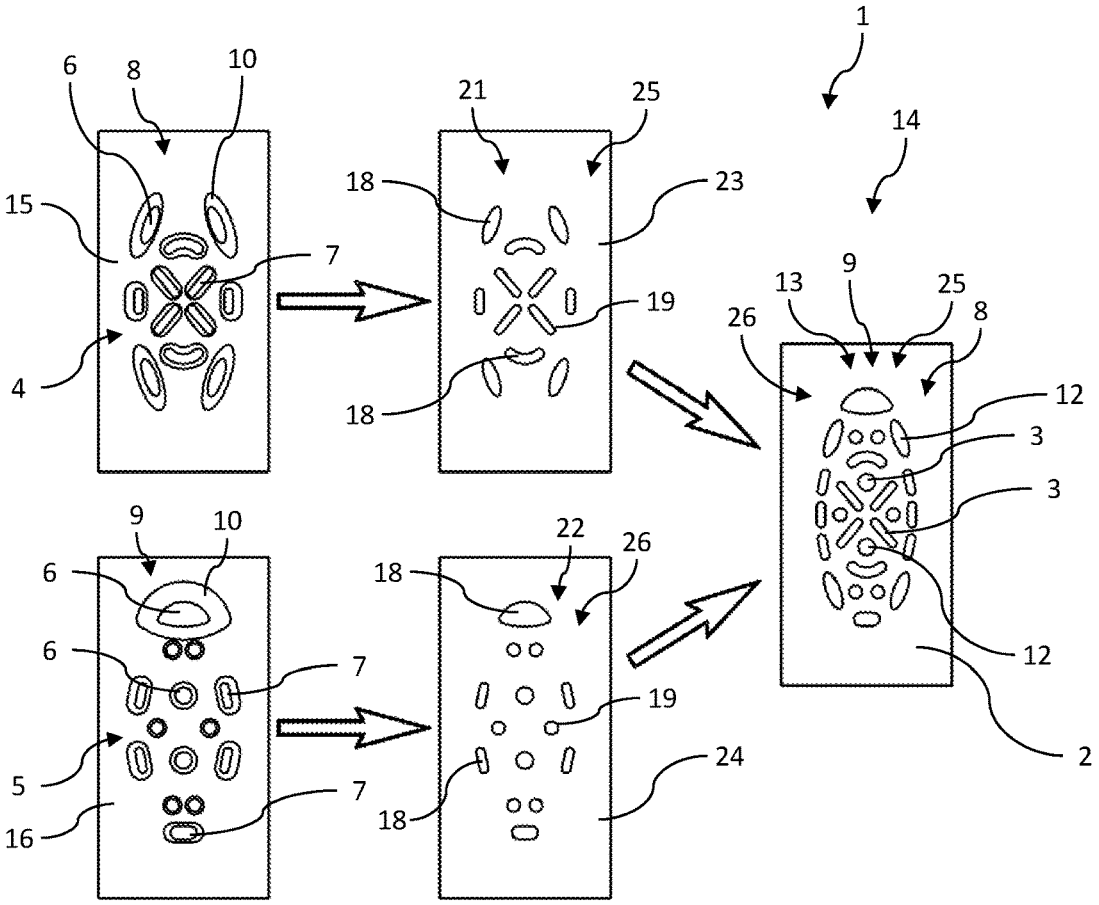
FIG. 4 depicts a top view of a device for producing bristle fields, in which the inventive technical theory is implemented, wherein a bristle field support plate, two compactor plates having in each case one arrangement of compactor holders and two funnel plates having in each case one arrangement of funnel holders can be seen from right to left.
Figure 5:
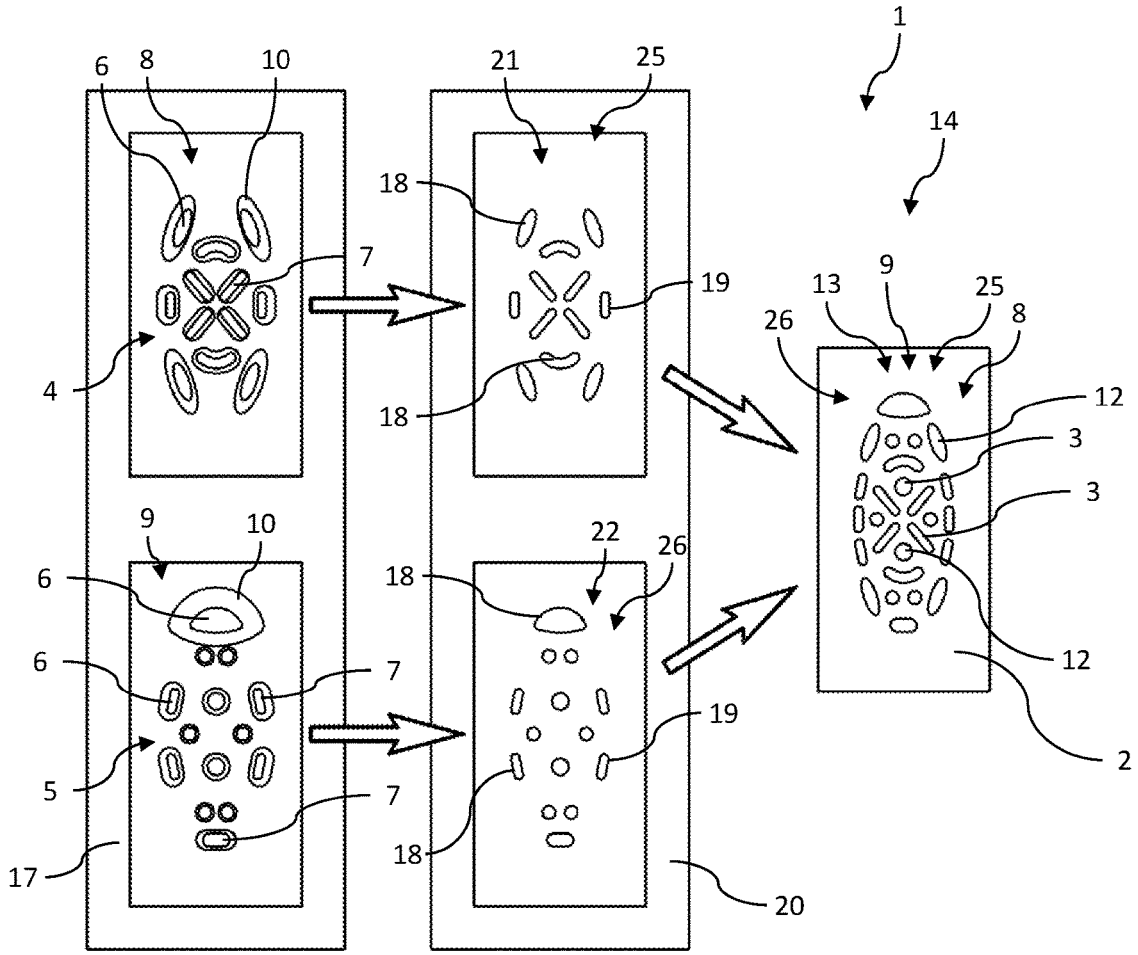
FIG. 5 depicts a top view of a further device for producing bristle fields in which the inventive technical theory is implemented, wherein a bristle field support plate, a compactor plate having two arrangements of compactor holders and a funnel plate having two arrangements of funnel holders can be seen from right to left.

FIGS. 4 and 5 depict in each case a device, designated in its entirety with 1, for producing bristle fields which are formed from individual bundles of bristles. Such bristle fields are used in the case of brushes and in particularly challenging designs, above all in the case of toothbrushes. Each of the devices 1 has a bristle field support plate 2. Bundle holders 3, into which the bundles of bristles for producing the bristle fields are delivered, are formed in the bristle field support plate 2.

Apart from the bristle field support plate 2, the device 1 has two different arrangements 4 and 5 of funnel holders 6 allocated to the bristle field support plate 2. Each of the arrangements 4 and 5 has funnel holders 6 for bundles of bristles, from which bundles of bristles for filling the bundle holders 3 of the bristle field support plate 2 are delivered. The arrangements 4 and 5 of funnel holders 6 are positioned upstream of the bristle field support plate 2 in the conveying direction of the bundles of bristles through the device 1.

The arrangements 4 and 5 of funnel holders 6 in each case have a concentration of funnel holders 6, which is smaller than a concentration of bundle holders 3 in the bristle field support plate 2. The bundle holders 3 of the at least one bristle field support plate 2 are filled at least indirectly with bundles of bristles from the funnel holders 6.

In both devices 1, the two arrangements 4 and 5 of funnel holders 6 have outlet openings 7 from their funnel holders 6, which produce different hole patterns 8 and 9 on the two arrangements 4 and 5. All the funnel holders 6 of the two arrangements 4, 5 in each case have an insertion funnel 10, through which bundles of bristles are introduced into the respective funnel holders 6.

Figure 1:
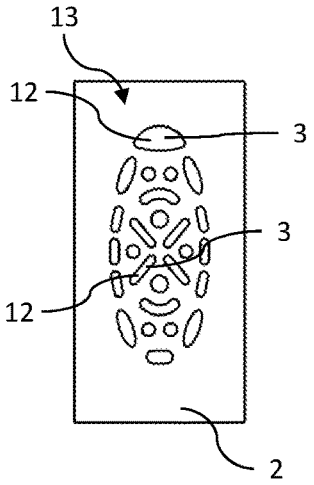
FIG. 1 depicts a top view of a bristle field support plate having multiple bundle holders, of which the inlet openings form a complete hole pattern, which corresponds to a top view of a bristle field to be produced.
Figure 2:
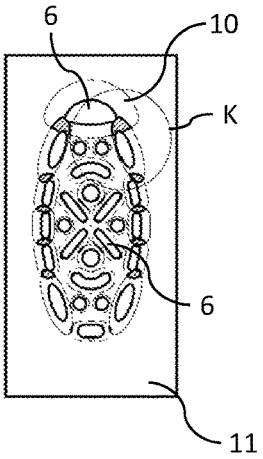
FIG. 2 depicts a top view of an individual funnel plate, which has all the funnel holders required for filling of all the bundle holders of the bristle field support plate represented in FIG. 1, wherein it can be appreciated on the basis of intersection regions represented with hatched lines that insertion funnels of the individual funnel holders merge into one another or overlap one another because of the high concentration of funnel holders on the funnel plate.
Figure 3:
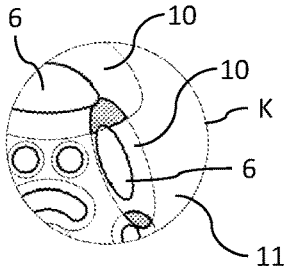
FIG. 3 depicts the detail marked with the circle K in FIG. 2 in an enlarged representation.

FIGS. 1 to 3 depict a funnel plate 11, in which the inventive technical theory is not implemented and the existing insertion funnels 10 overlap because of the high density of funnel holders 6 on the individual funnel plate 11. This is apparent from the regions represented with hatched lines in FIGS. 2 and 3. The overlapping of the insertion funnels 10 can result in a situation in which bundles of bristles cannot be fed cleanly to the funnel holders 6. Here individual bristle filaments can be fed unintentionally to an incorrect funnel holder 6. The devices 1 according to FIGS. 4 and 5 prevent such overlapping and the disadvantages associated therewith.

In both of the devices 1 represented in FIGS. 4 and 5, the funnel holders 6 required as a whole for filling the bundle holders 3 of the bristle field support plate 2 are distributed on the two separate arrangements 4 and 5 of funnel holders 6 in such a way that the concentration of funnel holders 6 present inside each of the arrangements 4 and 5 is smaller than the concentration of bundle holders 3 on the bristle field support plate 2. This leads to the positive effect that, for the insertion funnels 10 into the funnel holders 6 on the two arrangements 4 and 5, sufficient space is available to make the insertion funnels 10 as large as possible. According to FIGS. 4 and 5, the insertion funnels 10 are just as large as the insertion funnels 10 of the funnel plate 11 according to FIG. 2. Nevertheless, there is no overlapping of the insertion funnels 10 in the two arrangements 4 and 5 of funnel holders 6. Mis-feeding of bristle filaments caused by overlapping insertion funnels 10 can be avoided in this way.

FIGS. 4 and 5 illustrate clearly that hole patterns 8 and 9 formed in each case by the outlet openings 7 of the funnel holders 6 on the two arrangements 4 and 5 in relation to a complete hole pattern 13 formed by inlet openings 12 of the bundle holders 3 on the bristle field support plate 2 are complementary to one another. This means that each of the total number of funnel holders 6 that are distributed on the two arrangements 4 and 5 is precisely allocated to a bundle holder 3 of the bristle field support plate 2, and a number of the total number of funnel holders 6 that are present in the two arrangements 4 and 5 is as large as the number of the bundle holders 3 of the bristle field support plate to be filled. The hole patterns 8, 9 differ from one another.

It is clear that a superposition of the hole patterns 8 and 9 of the two arrangements 4 and 5 formed by the outlet openings 7 on the bristle field support plate 2 corresponds to the complete hole pattern 13 of the inlet openings 7 of the bundle holders 3 produced on the bristle field support plate 2. However, at least the longitudinal axes of the funnel holders 6 and the longitudinal axes of the bundle holders 3 are congruent in the case of this superposition. In other words, the two arrangements 4, 5 of funnel holders 6 are formed in such a way that an intended superposition of patterns, which are formed by longitudinal axes of the funnel holders 6, corresponds to an overall pattern formed by longitudinal axes of the bundle holders 3 on the bristle field support plate 2. The patterns and the overall pattern intended here are dot patterns, which, on the one hand, consist of points of intersection of the longitudinal axes of the funnel holders 6 with cross-sectional planes of the two arrangements 4 and 5 and, on the other hand, consist of points of intersection of the longitudinal axes of the bundle holders 3 with a cross-sectional plane of the bristle field support plate 2.

In the illustrative embodiment of the device 1 according to FIG. 4, the device 1 has a total of two funnel plates 15 and 16, on which one of the two arrangements 4 and 5 of funnel holders 6 is formed in each case. In the illustrative embodiment of the device 1 according to FIG. 5, the two arrangements 4 and 5 of funnel holders 6 are formed on a common funnel plate 17.

Each bundle holder 3 and each inlet opening 12 into a bundle holder 3 of the bristle field support plate 2 is allocated precisely to one of the outlet openings 7 from a funnel holder 6 of the two arrangements 4, 5. In this case, outlet openings 7 and inlet openings 12 of the bundle holders 3 that are allocated to one another exhibit the same cross-sectional form, although they can have different dimensions. The funnel holders 6 inside an arrangement 4 and 5 of funnel holders 6 also have longitudinal axes that are parallel to one another.

The device 1 can have a conveyor device having at least one pressure source and/or having at least one pressure sink to produce a gas flow, in particular a flow of compressed air. With such gas flow, the bundles of bristles can be introduced by positive pressure and/or negative pressure, preferably by compressed air, into the funnel holders 6 of the at least two arrangements 4,5.

The device 1 can also comprise, preferably as a supplement thereto, at least one sliding mechanism, with the bundle of bristles inserted into the funnel holders 6 and/or from the funnel holders 6 into downstream holders, for example into the bundle holders 3 of the bristle field support plate 2, or can also be transferred into compactor holders 18 that are described in detail below.

The bristle field support plate 2 is a part of the device 1. It is also possible, however, to use hole plates of a kind which remain in the device 1 only temporarily and, after filling with bundles of bristles, are attached to a brush body and thus become part of the brush to be produced.

The device 1 is arranged on a brush manufacturing machine designated in its entirety with 14 and is represented in only a highly schematized manner in the Figures.

The following method can be performed on the previously described device 1:

It is envisaged in this case to fill the bundle holders 3 of a bristle field support plate 2 with bundles of bristles from at least two different arrangements 4, 5 of funnel holders 6. The bundles of bristles are fed to the bundle holders 3 of the bristle field support plate 2 in the depicted illustrative embodiment indirectly via the funnel holders 6 exhibiting insertion funnels 10. The funnel holders 6 are distributed on the two arrangements 4 and 5 of funnel holders 6 in such a way that a concentration of funnel holders 6 in the at least two arrangements 4 and 5 in each case is smaller than a concentration of bundle holders 3 on the bristle field support plate 2.

In the two arrangements 4 and 5 of funnel holders 6, a group of bundles and/or in each case a bristle sub-field are formed from bundles of bristles in each case. In a downstream process step, the groups of bundles and/or bristle sub-fields thereby produced are introduced one after the other into the bundle holders 3 of the bristle field support plate 2.

In the process, all the bundle holders 3 of the bristle field support plate 2 are filled with bundles of bristles by the two arrangements 4, 5. For this purpose, the arrangements 4 and 5 can be brought one after the other into a transfer position on the bristle field support plate 2, and the bristle field support plate 2 can be filled with bundles of bristles.

It is provided here, however, that the bundles of bristles are transferred from the funnel holders 6 of the at least two arrangements 4 and 5 first of all to compactor holders 18 of the device 1. The funnel holders 6 are used to impart a desired cross-sectional form to the bundles of bristles. The compactor holders 18 serve the purpose of compacting the bundles of bristles with a constant cross-sectional form while reducing their bundle cross-section. The bundles of bristles are subsequently delivered from the compactor holders 18 to the bundle holders 3 of the bristle field support plate 2. In order to facilitate the compaction of the bundles of bristles by the compactor holders 18, these have lead-in chamfers 19 which taper down to an internal cross section of the compactor holders 18. The bundles of bristles can thus be delivered more easily from the outlet openings 7 to the compactor holders 18.

In both illustrative embodiments of the device 1, the compactor holders 18 are combined together in two arrangements 21 and 22.

According to FIG. 4, the first arrangement 21 is formed on a first compactor plate 23, and the second arrangement 22 is formed on a second compactor plate 24. According to FIG. 5, the two arrangements 21 and 22 are formed jointly on a compactor plate 20. Each of the arrangements 21 and 22 in each case has a compactor hole pattern 25, 26 formed by its compactor holders 18 that are oriented parallel to one another. The compactor hole patterns 25 and 26 correspond to the hole patterns 8 and 9 of the arrangements 4 and 5 of funnel holders 6 and are in addition likewise complementary in relation to the complete hole pattern 13 of the bundle holders 3 on the bristle field support plate 2.

For filling of the bristle field support plate 2, the bundles of bristles are delivered first of all to the two arrangements 4 and 5 of funnel holders 6. The bundles of bristles then arrive at the two arrangements 21 and 22 of compactor holders 18. The arrangements 21 and 22 are subsequently brought one after the other into a transfer position on the bristle field support plate 2, and the bristle sub-fields are delivered to the bundle holders 3. It is also possible, however, to bring the bristle field support plate 2 first of all into a transfer position on the first arrangement 21 and then into a transfer position on the second arrangement 22, in order to fill the bundle holders 3 assigned to the compactor holders 18 in each case with bundles of bristles.

In the two arrangements 4, 5, bristle sub-fields that are complementary to one another in relation to the bristle field to be produced are formed from bundles of bristles. Subsequently, the bristle sub-fields that are complementary to one another are first of all delivered to the arrangements 21 and 22 of compactor holders 18 and are then combined together one after the other in the bristle field support plate 2 in order to form the bristle field to be produced.

The bundles of bristles can be introduced into the funnel holders 6 by positive pressure and/or negative pressure, preferably by compressed air, and/or by a single sliding mechanism or by one sliding mechanism in each case.

The bundles of bristles can be transferred even more effectively by a single sliding mechanism or by one sliding mechanism in each case from the funnel holders 6 into the compactor holders 18 and from there in turn into the bundle holders 3 of the bristle field support plate 2.

The bundles of bristles are introduced through the insertion funnels 10 into the funnel holders 6 of the two arrangements 4 and 5. Furthermore, the bundles of bristles are contoured in the funnel holders 6 of the funnel plates 4 and 5 according to their cross-sectional form in the bristle field to be produced.

LIST OF REFERENCE DESIGNATIONS

1 device
2 bristle field support plate
3 bundle holder on 2
4 first arrangement of 6
5 second arrangement of 6
6 funnel holder
7 outlet opening from 6
8 hole pattern of 4
9 hole pattern of 5
10 insertion funnels
11 funnel plate
12 inlet openings in 3
13 complete hole pattern
14 brush manufacturing machine
15 first funnel plate
16 second funnel plate
17 common funnel plate
18 compactor holders
19 lead-in chamfers
20 common compactor plate
21 first arrangement of 18
22 second arrangement of 18
23 first compactor plate
24 second compactor plate
25 compactor hole pattern
26 compactor hole pattern

The invention claimed is:

1. A method for producing a bristle field including multiple bundles of bristles for a brush, the method comprising:

filling bundle holders (3) of a bristle field support plate (2) with bundles of bristles, delivering the bundles of bristles, at least for indirect filling of the bundle holders (3) of the bristle field support plate (2), from funnel holders (6) having insertion funnels (10), which are distributed on at least two arrangements (4,5) of the funnel holders (6), and a concentration of the funnel holders (6) in the at least two arrangements (4,5) is smaller in each case than a concentration of the bundle holders (3) on the bristle field support plate (2).

2. The method as claimed in claim 1, further comprising forming, in the at least two arrangements (4,5) of the funnel holders (6), in each case at least one of a group of bundles or a bristle sub-field from the bundles of bristles, and introducing the at least one of the groups of bundles or the bristle sub-fields produced thereby into the bundle holders (3) of the bristle field support plate (2) in a downstream process step and combining together the at least one of the groups of bundles or the bristle sub-fields from the at least two arrangements into the bristle field to be produced.

3. The method as claimed in claim 1, further comprising at least one of providing outlet openings (7) of the funnel holders (6) of the at least two arrangements (4,5) with different hole patterns (8,9), or providing the funnel holders (6) inside one of the arrangements (4,5) of the funnel holders (6) with longitudinal axes that are parallel to one another.

4. The method as claimed in claim 1, further comprising delivering the bundles of bristles from outlet openings (7) of the at least two arrangements (4,5) to the bundle holders (3) of the bristle field support plate (2), the outlet openings (7) of the at least two arrangements (4,5) form hole patterns (8,9), which are complementary in relation to a complete hole pattern (13) formed by inlet openings (12) of the bundle holders (3) on the bristle field support plate (2), or delivering the bundles of bristles from outlet openings (7) of the transport holders (6) of the at least two arrangements (4,5) to compactor holders (18), from which the bundles of bristles are delivered to the bundle holders (3) of the bristle field support plate (2).

5. The method as claimed in claim 2, further comprising in the at least two arrangements (4,5) of funnel holders (6), forming the at least one of the groups of bundles or the bristle sub-fields that are complementary to one another in relation to the bristle field to be produced from the bundles of bristles, and bringing the at least one of the groups of bundles or bristle sub-fields that are complementary to one another together in the bristle field support plate (2) one after the other, in a downstream process step in order to form the bristle field to be produced.

6. The method as claimed in claim 1, further comprising introducing the bundles of bristles by at least one of a positive pressure, negative pressure, a single sliding mechanism, or sliding mechanisms for each of the at least two arrangements (4, 5) into the funnel holders (6) of the at least two arrangements (4,5).

7. The method as claimed in claim 1, further comprising introducing the bundles of bristles into either the bundle holders (3) of the bristle field support plate (2) or into compactor holders (18) by a single sliding mechanism or by one sliding mechanism for each of the at least two arrangements.

8. The method as claimed in claim 1, further comprising contouring the bundles of bristles by introduction into the funnel holders (6) in order to produce a desired cross-sectional form in the bristle field to be produced.

9. A device (1) for producing bristle fields including bundles of bristles for brushes, the device (1) comprising:

at least one bristle field support plate (2) with bundle holders (3), at least two arrangements (4,5) of funnel holders (6), each of the at least two arrangements has a concentration of the funnel holders (6) that is smaller than a concentration of the bundle holders (3) in the bristle field support plate (2), and the bundle holders (3) of the at least one bristle field support plate (2) are adapted to be filled at least indirectly with the bundles of bristles.

10. The device (1) as claimed in claim 9, wherein the at least two arrangements (4,5) are formed on a common funnel plate (17), or each of the at least two arrangements (4,5) is formed in on a respective single funnel plate (15,16), and hole patterns (8,9), which are formed by outlet openings (7) of the funnel holders (6) of the at least two arrangements (4,5), differ from one another.

11. The device (1) as claimed in claim 9, wherein the funnel holders (6) of one of said arrangements (4,5) of funnel holders (6) have longitudinal axes that are parallel to one another.

12. The device (1) as claimed in claim 9, wherein hole patterns (8,9) formed from outlet openings (7) of the funnel holders (6) on the at least two arrangements (4,5) are complementary to one another in relation to a complete hole pattern (13) formed by inlet openings (12) of the bundle holders (3) on the bristle field support plate (2).

13. The device (1) as claimed in claim 12, wherein a superposition of the hole patterns (8,9) formed on the bristle field support plate (2) by the outlet openings (7) on the at least two arrangements (4,5) corresponds to a complete hole pattern (13) produced by the inlet openings (12) of the bundle holders (3) on the bristle field support plate (2).

14. The device (1) as claimed in claim 9, wherein precisely one of the outlet openings (7) of the funnel holders (6) on the at least two arrangements (4, 5) is assigned to each said bundle holder (3) of the bristle field support plate (2), and the outlet openings (7) and the inlet openings (12) of the bundle holders (3) that are assigned to one another exhibit a same cross-sectional form.

15. The device (1) as claimed in claim 9, wherein, in a hole pattern (8,9) of the funnel holders of one of the at least two arrangements (4,5), only outlet openings (7) from the funnel holders (6) that are combined together are those through which the bundle holders (3) on the bristle field support plate (2) that are not directly adjacent are adapted to be filled with bundles of bristles.

16. The device (1) as claimed in claim 9, further comprising a conveyor device having at least one of a pressure source or a pressure sink for producing a gas flow by which the bundles of bristles are capable of being introduced into the funnel holders (6) of the at least two arrangements (4,5) by at least one of a positive pressure or a negative pressure.

17. The device (1) as claimed in claim 9, further comprising at least one sliding mechanism, by which bundles of bristles are adapted to be at least one of inserted into the funnel holders (6) of the at least two funnel plates (4,5) or transferred from the funnel holders (6) into the bundle holders (3) of the bristle field support plate (2).

18. The device (1) as claimed in claim 9, wherein the at least two arrangements (4,5) of funnel holders (6) are positioned upstream in a conveying direction of the bundles of bristles from the bristle field support plate (2).

19. The device (1) as claimed in claim 9, further comprising compactor holders (18), into which the bundles of bristles for a bundle of bristles compaction are introducible from the funnel holders (6), and from which the bundles of bristles are adapted to be delivered to the bundle holders (3) of the bristle field support plate (2).

20. A brush manufacturing machine (14) comprising the device (1) for producing bristle fields as claimed in claim 9.

* * * * *